US009364379B2

(12) United States Patent
Hammond et al.

(10) Patent No.: US 9,364,379 B2
(45) Date of Patent: Jun. 14, 2016

(54) STANDING MOBILITY AND/OR TRANSFER DEVICE

(75) Inventors: Gary Hammond, Bancroft, MI (US); Dan Davis, Mt. Morris, MI (US)

(73) Assignee: Standing Normal LLC, Mt. Morris, MI (US)

( * ) Notice: Subject to any disclaimer, the term of this patent is extended or adjusted under 35 U.S.C. 154(b) by 552 days.

(21) Appl. No.: 13/442,377

(22) Filed: Apr. 9, 2012

(65) Prior Publication Data

US 2012/0255118 A1 Oct. 11, 2012

Related U.S. Application Data

(60) Provisional application No. 61/472,720, filed on Apr. 7, 2011.

(51) Int. Cl.
*A61G 7/10* (2006.01)

(52) U.S. Cl.
CPC ..... *A61G 7/1017* (2013.01); *A61G 7/109* (2013.01); *A61G 7/1048* (2013.01); *A61G 7/1051* (2013.01); *A61G 7/1086* (2013.01); *A61G 7/1092* (2013.01); *A61G 7/1096* (2013.01); *A61G 7/1098* (2013.01); *A61G 2200/34* (2013.01); *A61G 2200/36* (2013.01); *A61G 2203/14* (2013.01)

(58) Field of Classification Search
CPC ... A61G 7/1017; A61G 7/1096; A61G 7/109; A61G 7/1051; A61G 7/1092; A61G 7/1086; A61G 7/1098; A61G 7/1048; A61G 2200/34; A61G 2203/14; A61G 2200/36
USPC ..... 5/81.1 R, 83.1, 85.1, 87.1, 86.1, 89.1, 5/81.1 T
See application file for complete search history.

(56) References Cited

U.S. PATENT DOCUMENTS

| | | | | |
|---|---|---|---|---|
| 3,789,722 | A * | 2/1974 | Hanes | G10C 3/14 84/426 |
| 4,290,423 | A | 9/1981 | Kleinwolterink | |
| 4,510,633 | A * | 4/1985 | Thorne | 5/87.1 |
| 4,538,857 | A | 9/1985 | Engman | |
| 4,704,749 | A | 11/1987 | Aubert | |
| 4,809,804 | A * | 3/1989 | Houston et al. | 180/65.51 |
| 5,054,852 | A | 10/1991 | Tholkes | |
| 5,189,741 | A * | 3/1993 | Beardmore | 5/86.1 |

(Continued)

OTHER PUBLICATIONS

EasyStand StrapStand by Altimate Medical http://www.easystand.com/strapstand/index.cfm.

(Continued)

*Primary Examiner* — Robert G Santos
*Assistant Examiner* — Myles Throop
(74) *Attorney, Agent, or Firm* — Endurance Law Group, PLC

(57) ABSTRACT

The present invention provides a standing mobility and/or transfer device for handicapped users including an articulating foot platform system effective to move a foot platform between a rearwardly tilted user-receiving condition located close to the floor and an elevated, forwardly tilted condition for user transport at a standing-prone angle. Bilateral lift arms move in concert with the raising and lowering function of the foot platform to elevate the person to a standing-prone position from a seated position. In a raised position, the lift arms are located alongside a user to provide additional posture control. Optional motors associated with one or more wheels of the device may be controlled by the user with a joystick for self-propelled standing mobility.

19 Claims, 13 Drawing Sheets

(56) References Cited

U.S. PATENT DOCUMENTS

| | | | | |
|---|---|---|---|---|
| 6,092,247 | A * | 7/2000 | Wilson | 5/86.1 |
| 6,119,287 | A * | 9/2000 | Phillips | 5/81.1 RP |
| 6,175,973 | B1 * | 1/2001 | Hakamiun et al. | 5/89.1 |
| 6,440,046 | B1 | 8/2002 | Tholkes | |
| 7,392,554 | B1 | 7/2008 | Su et al. | |
| 7,503,879 | B2 * | 3/2009 | Liao | A63B 21/012 482/114 |
| 7,921,485 | B2 | 4/2011 | Biersteker et al. | |
| 7,921,486 | B2 | 4/2011 | Biersteker et al. | |
| 7,938,756 | B2 | 5/2011 | Rodetsky et al. | |
| 8,122,534 | B2 * | 2/2012 | Biersteker et al. | 5/86.1 |
| 2009/0119835 | A1 * | 5/2009 | Liljedahl | 5/87.1 |
| 2010/0013276 | A1 | 1/2010 | Tholkes et al. | |
| 2010/0031439 | A1 * | 2/2010 | Spidare et al. | 5/87.1 |
| 2010/0162483 | A1 * | 7/2010 | Biersteker et al. | 5/87.1 |
| 2012/0255118 | A1 * | 10/2012 | Hammond et al. | 5/86.1 |
| 2013/0219615 | A1 * | 8/2013 | Eklof et al. | 5/83.1 |
| 2014/0109312 | A1 * | 4/2014 | Gray | 5/86.1 |

OTHER PUBLICATIONS

Joerns Healthcare—Lifting & Repositioning Brochure. http://www.joerns.com/pdfs_products/patient-handling/journey/Joerns_Healthcare_Lifting_Repositioning_Brochure_3.pdf.

Joerns Healthcare—Patient Handling. http://www.joerns.com/safety-solutions/patient-handling.

TEK Robotic Mobilization Device. http://tekrmd.com/.

* cited by examiner

STANDING MOBILITY AND/OR TRANSFER DEVICE

CROSS REFERENCE TO RELATED APPLICATIONS

This application claims priority to Provisional Patent Application No. 61/472,720 filed Apr. 7, 2011, the entire disclosure of which is hereby incorporated by reference and relied upon.

BACKGROUND OF THE INVENTION

1. Field of the Invention

This invention relates generally to lift and/or transfer devices for handicapped individuals, and more particularly such a hoisting device including a transportable support movable along a floor or the ground.

2. Related Art

Clinical experience suggests that wheelchair users often experience painful, problematic and costly secondary complications due to long term sitting. Standing is an effective way to counterbalance many of the negative effects of constant sitting. Standing devices (sometimes referred to as "Standers") integrated into wheelchair bases enhance the beneficial effects of standing since they allow for more frequent, random and independent performance of standing than in persons who use standing devices outside of a wheelchair base. Integration of a standing device feature into the wheelchair base also enables user standing to enhance functional activities.

A standing feature integrated into a wheelchair base allows the user to obtain a standing position without the need to transfer from the wheelchair. A mechanical or electromechanical system manipulated via levers or the wheelchair's controls moves the seat surface from horizontal into vertical or posteriorly sloping position as it is tilted rearward at the top while maintaining verticality of the leg rests and backrest, thus extending the hip and knee joints. A full vertical standing position (i.e., standing-erect) can be achieved directly from sitting, or through gradual angle changes from a laying position, or a combination of these positions. Most wheelchair standers allow for full or partial extension of the hip and knee joints, and full upright or partially tilted positions. Wheelchair standers are available on manual or power wheelchair bases.

Examples of standing wheelchairs may be found in the SuperStand Standing Wheelchair manufactured by the Standing Company of Saginaw, Mich., and the Levo C3, manufactured by Levo USA of Brooklyn Park, Minn. Wheelchair standers have several shortcomings. As one example, they are not conveniently suited to transfer a user from an ordinary chair or standard wheelchair into a standing position. In another case, wheelchair standers typically arrange the wheels in such a manner that the device does not have inherent stability, and therefore are limited in their ability to transport users over a wide variety of terrain or in tight interior conditions.

The Standing Dani® dynamic stander, manufactured by Davis Made Inc. of Flint, Mich. produces a device that is, in many respects, superior to other dynamic standers on the market. The self-propelled Standing Dani® dynamic stander is designed to be support a user in a standing-prone position, i.e., the user is supported while leaning slightly forward. With this device, the user can easily maneuver indoors and outdoors similar to a wheel chair, and the overall architecture of the device provides inherent stability thus overcoming many of the deficiencies of competing wheelchair standers. The self-propelled Standing Dani® is powered by an electrical drive unit that allows a user to cover long distances quickly and easily. The motors are concealed within the wheel hubs.

User transfer between sitting and standing positions, and/or from a bed to a chair or the like, is a significant source of injury to health care workers. The act of manually lifting a user exposes a health care worker to serious strain on the back and shoulder. Transfer devices have thus been developed to assist in the lifting and transfer function of handicapped users. For example, U.S. Pat. No. 6,119,287 to Phillips, issued Sep. 19, 2000, discloses a lift and transfer apparatus for a disabled person. Pivoting lift arms rotate to lift a user by the forearms from a seated or laying position into a standing position onto a rotating platform. A flat foot platform is fixed in position for the user to stand upon during the transport procedure. The lift arm does not offer the user posture control functionality when in the raised position.

Related U.S. Pat. Nos. 7,921,485, 7,921,486 and 8,122,534 to Biersteker et al. disclose user lifts believed to be sold commercially as the Hoyer Elevate, Hoyer Journey and Hoyer Ascend products. The lift device includes a lift arm attached to the upper end of a support tower through a simple pivot. A knee pad is attached to the tower. An actuator moves the lift arm between lowered and raised positions. A fixed foot platform may be selectively repositioned to a non-use position to facilitate gate training. The foot platform does not raise or change its angle in concert with movement of the lift arm. Further, the lift arm does not offer the user posture control functionality when in the raised position.

Despite these many sincere attempts to provide functional, convenient standing mobility and/or transfer devices for handicapped people, there remains a need to provide even more effective, more convenient features in a dynamic stander type device to reliably transfer a user from an ordinary chair or standard wheelchair into a standing-prone position coupled, optionally, with mobility functionality.

SUMMARY OF THE INVENTION

In accordance with a first embodiment of this invention, a standing mobility and/or transfer device is provided for handicapped individuals. The device includes a mobile base and a foot platform. The foot platform is connected to the mobile base at an elevated forwardly tilted angle above a ground surface to comfortably support a person in a standing-prone orientation. An actuator is operatively disposed between the foot platform and the mobile base. The actuator is configured to rotate the foot platform rearwardly to receive a seated user and then return to the elevated forwardly tilted condition for user transport and/or mobility at a standing-prone angle.

In accordance with a second embodiment of this invention, a standing mobility and/or transfer device is provided for handicapped individuals. The device includes a mobile base and a foot platform connected to the mobile base. The foot platform has a generally flat standing surface. Left and right lift arms are operatively connected with respect to the mobile base for articulating movement between a lowered condition and a raised condition. The left and right lift arms each extend between a respective proximal end and a cantilevered distal end. An actuator is supported relative to the mobile base. The actuator is effective to selectively move the left and right lift arms in concert between raised and lowered condition. At least one arm control linkage is operatively connected to the respective left and right lift arms. The arm control linkage is configured to orient the left and right lift arms generally horizontal in the lowered condition and generally vertical in the raised condition. In the raised condition, the left and right lift arms are oriented generally vertically and lie in a region generally perpendicular to the standing surface of the foot platform. In the raised condition the left and right lift arms enable user posture control by assuming respective positions along the sides of a supported user so that the user is able to wrap at least one of their arms around one of the left and right lift arms.

The present invention provides a more effective, more convenient dynamic stander type device capable of independent transfer of a user from an ordinary chair or standard wheelchair into a standing position and/or with independent upright mobility.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
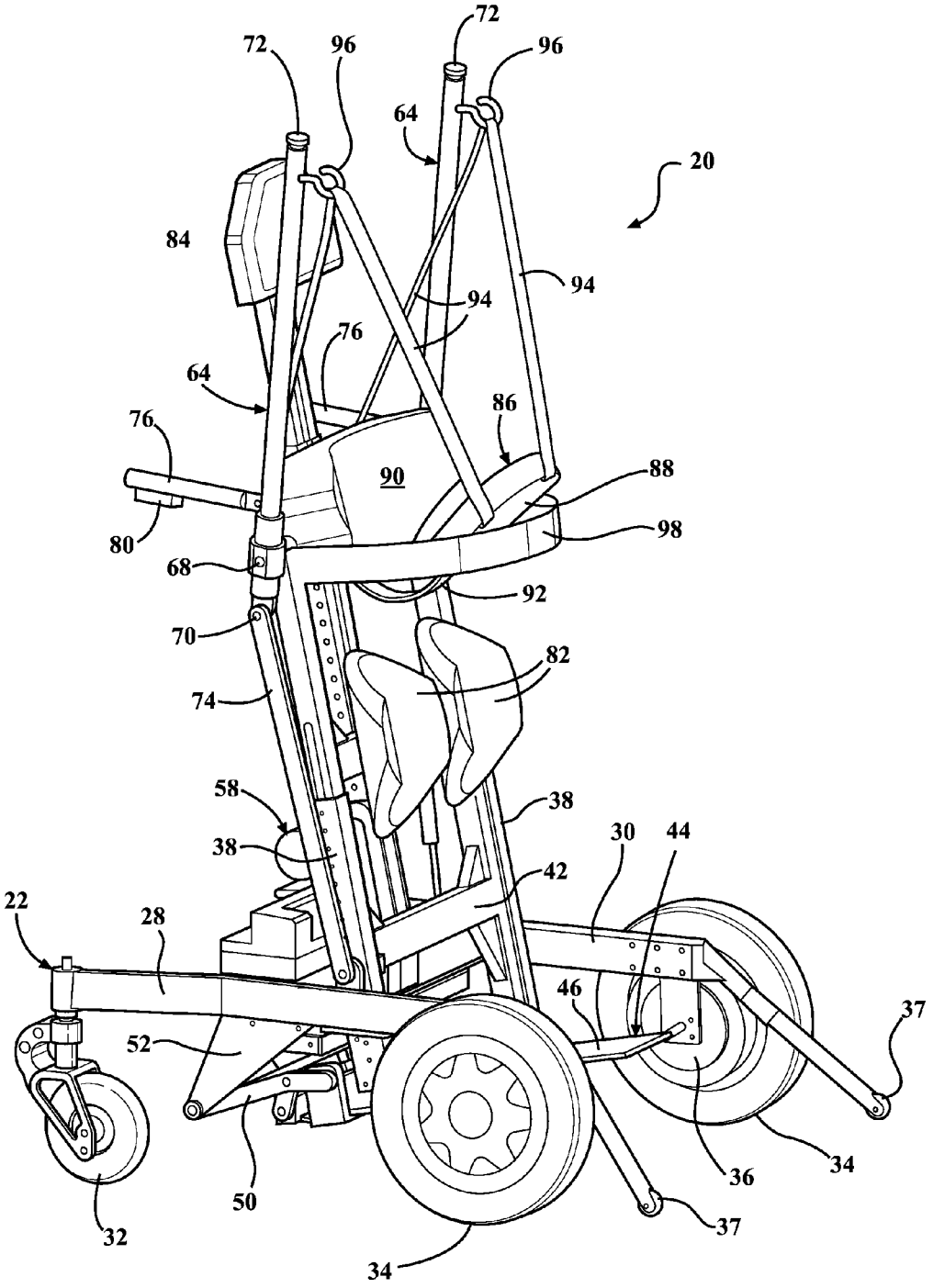
FIG. 1 is a perspective view of a standing mobility and/or transfer device according to the subject invention showing lift arms and foot platforms in a raised position.

Referring to the figures wherein like numerals indicate like or corresponding parts throughout the several views, a standing mobility and/or transfer device for handicapped individuals is generally shown at 20 in FIGS. 1-8. The device 20 includes a mobile base, generally indicated at 22, which in one example is a frame-like construction defined by a front edge 24, back edge 26, and left and right edges 28, 30 respectively. Of course, platform style and other constructions for the mobile base 22 are within the scope of this invention. In the preferred embodiment, the mobile base 22 includes two front wheels 32 and two rear wheels 34 attached to forward and rearward extensions of the left 28 and right 30 edges, respectively. In alternative embodiments fully contemplated by this invention, the device 20 may include more or less than four wheels, including for example the two-wheel dynamic balancing devices popularized by Segway, three-wheel devices, five- and six-wheel devices and the like. Preferably, the front wheels 32 are attached to the mobile base 20 via 360-degree swiveling caster-like units whereas the rear wheels 34 are attached on non-articulating axles. The caster units associated with the front wheels 32 are preferably ruggedly constructed to provide a high degree of mobility and operability over a variety of terrain types. As perhaps best shown in FIG. 3, the rear wheels 34 may be fitted with electric motor drive units 36 and the hubs thereof, or otherwise operatively connected thereto to provide motorized transport and control for the device 20. Examples of hub-mounted electric motor drive units 36 may be seen, for example, in the self-propelled Standing Dani® dynamic stander, manufactured by Davis Made Inc. of Flint, Mich. The device 20 may be fitted with anti-tip extensions 37 extending rearwardly and downwardly from the left 28 and right 30 edges of the mobile base 22, behind the rear wheels 34.

Figure 3:
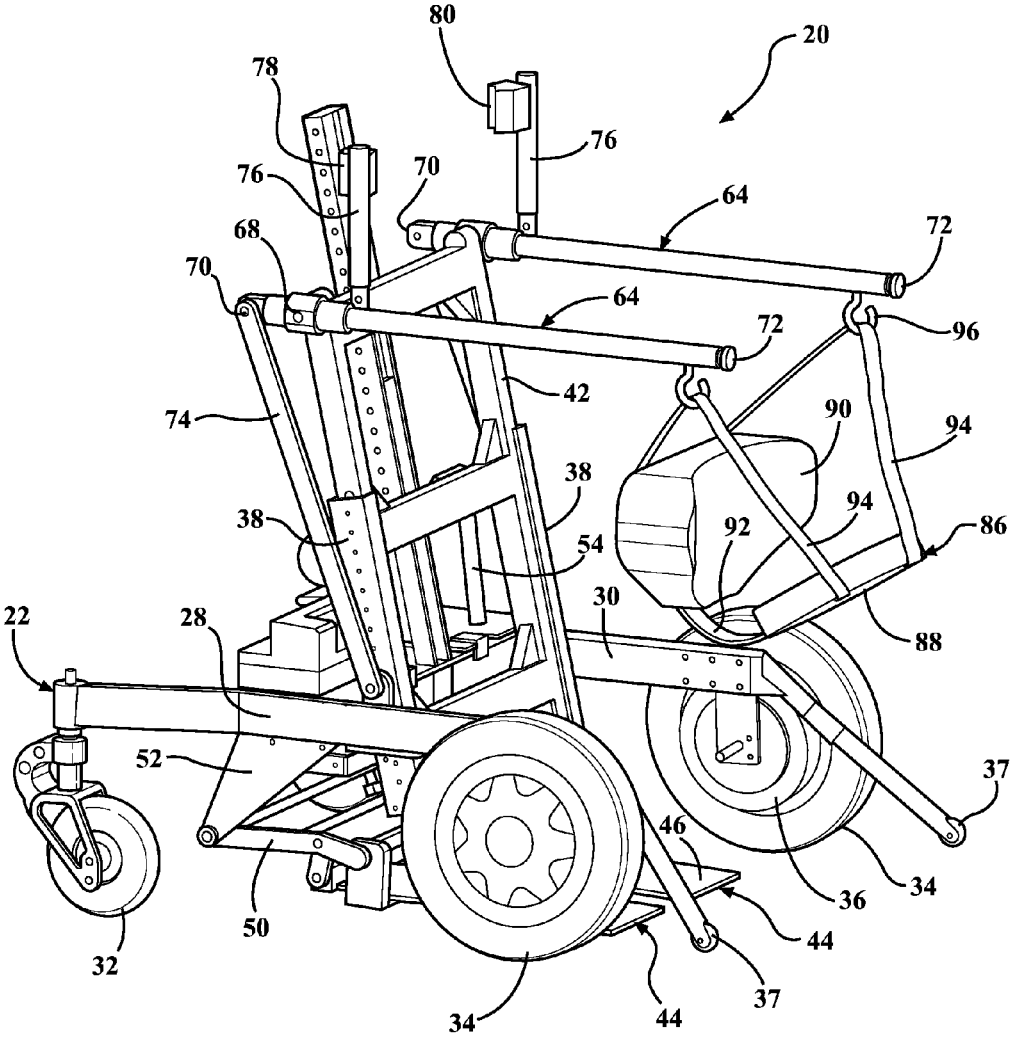
FIG. 3 is an enlarged fragmentary, sideward facing perspective view of the lower portion of the device as shown in FIG. 2.
Figure 4:
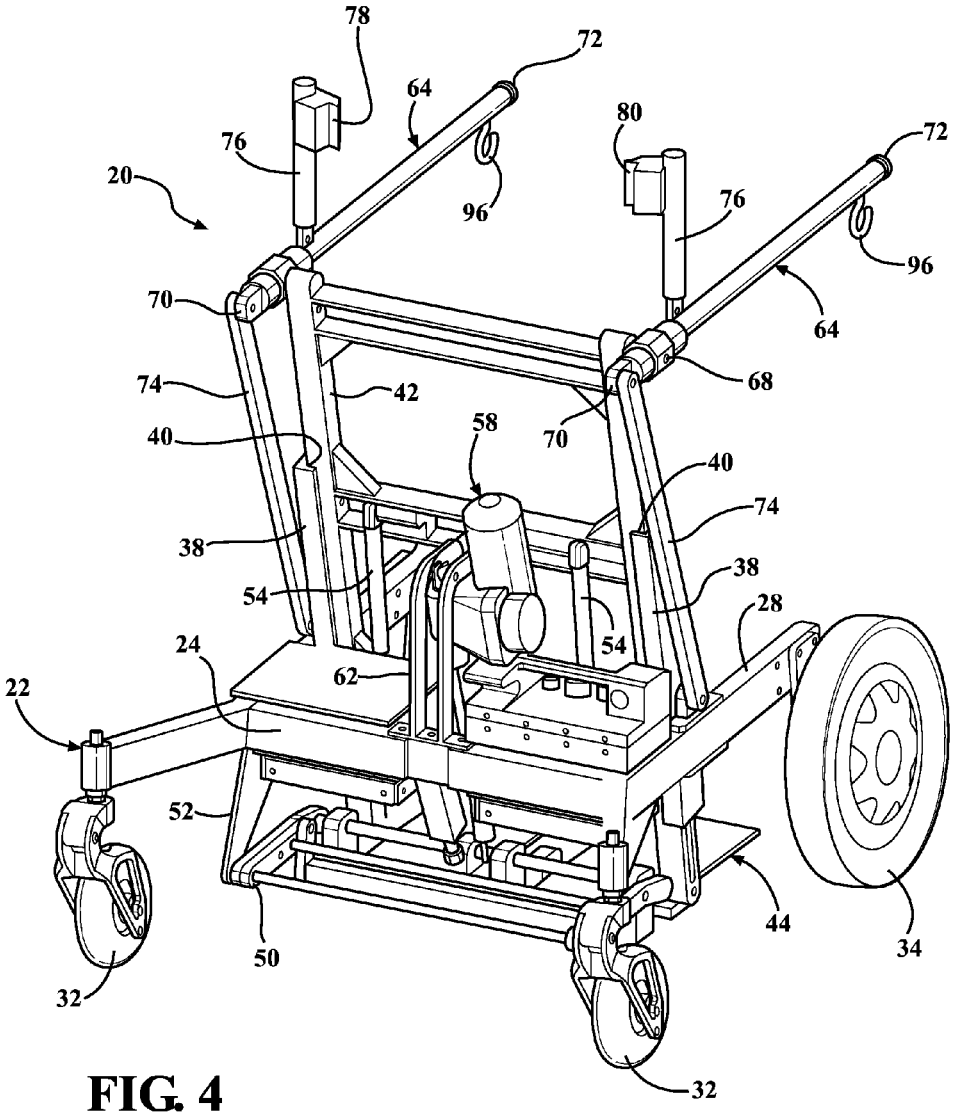
FIG. 4 is an enlarged fragmentary, rearward facing perspective view of the lower portion of the device as shown in FIG. 3.
Figure 5:
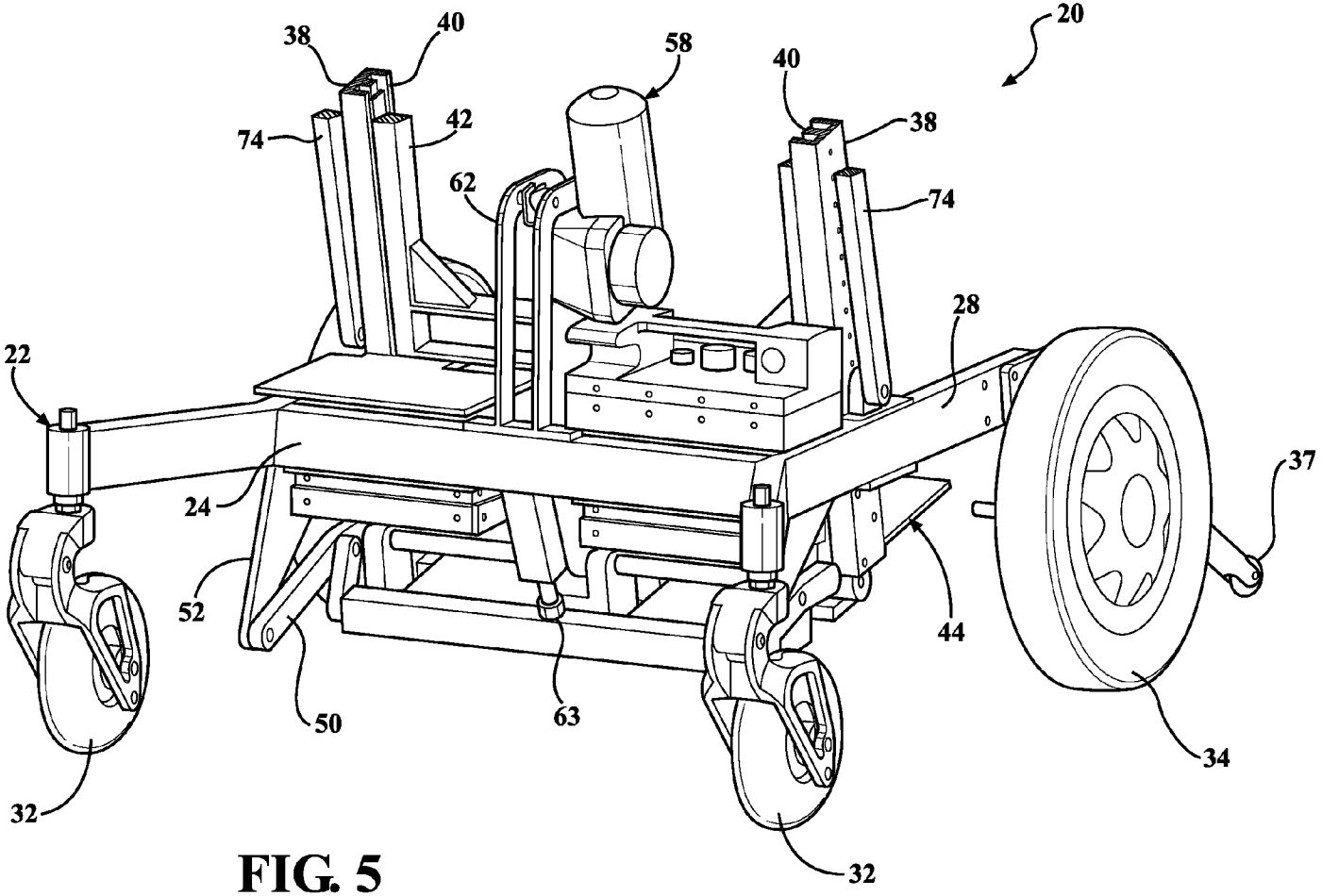
FIG. 5 is an enlarged fragmentary, rearward facing perspective view of the mobility base and actuator features of the preferred embodiment.

Referring more particularly now to FIGS. 3-5, the device 20 is further shown including left and right towers 38 affixed, respectively, to the left 28 and right 30 edges of the mobile base 20. Each of the left and right towers 38 include an inwardly facing slide track as perhaps best shown in FIG. 5. The slide track 40 of each of the left and right towers 38 are oriented generally parallel to one another and are supported from the mobile base 22 in a standing-prone angular orientation. That is, the angle of the slide tracks 40 is not vertical but preferably is oriented between about 0 and 40 degrees from vertical in a standing-prone orientation. Generally stated, "standing-prone" means that the user is in an upright, forward-leaning orientation. The standing-prone orientation is believed to advantageously activate muscles that are otherwise at rest when standing-erect and standing-supine.

A carriage 42 is slidably disposed in the respective sliding tracks 40 in the left and right towers 38 somewhat akin to the sliding movement of a hung window in a window frame. The carriage 42 is thus operatively disposed for movement between raised and lowered conditions via the slide tracks 40 in the towers 38. In the illustrated embodiments, the carriage 42 appears as a rectangular frame-like unit. However those of skill in the art will appreciate various alternative configurations and designs for the carriage 42 in alternative but equivalent implementations of this concept.

Figure 8:
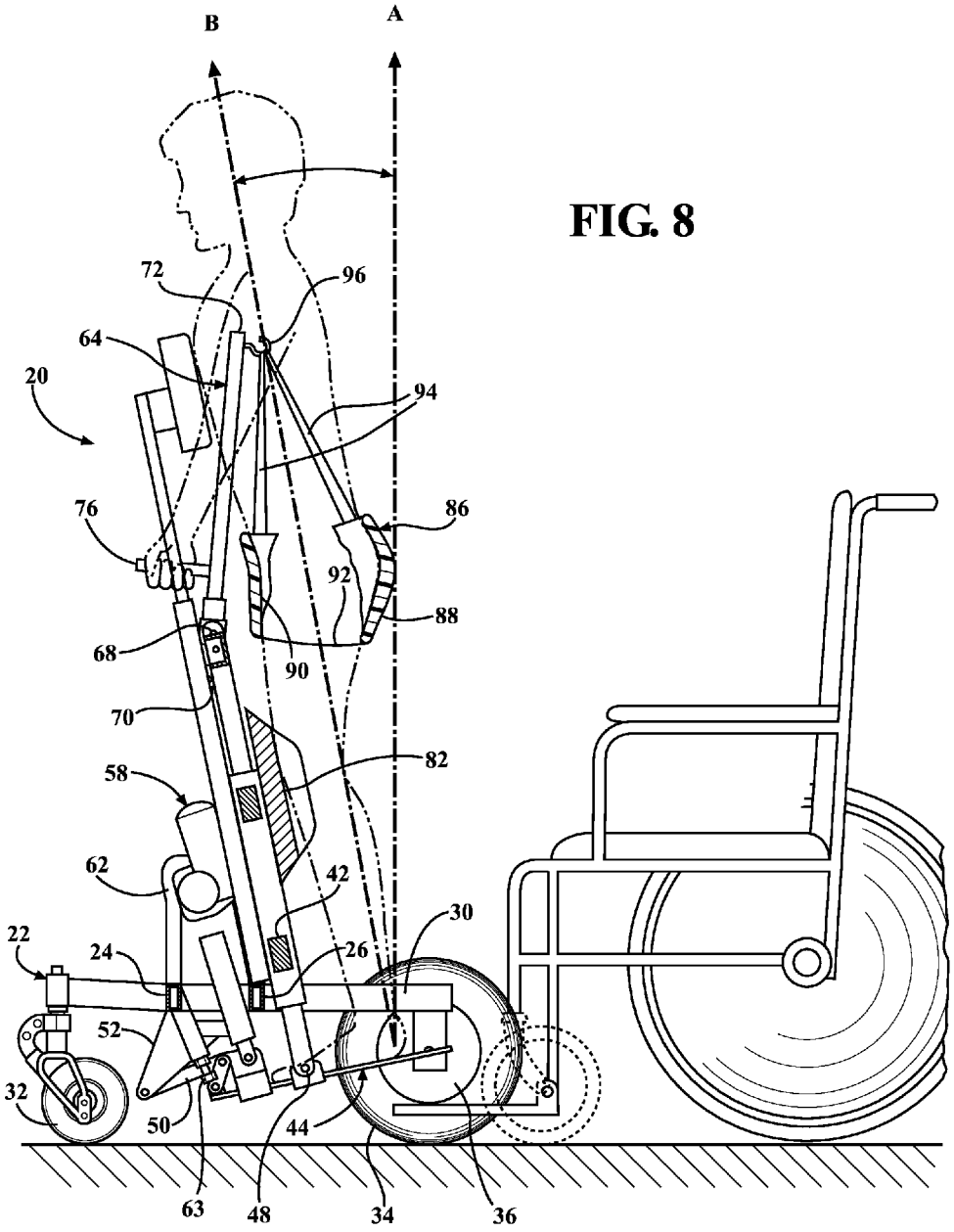
FIG. 8 is a view as in FIG. 7 showing a further progression of the transfer process wherein the person has been hoisted to a standing-prone position.
Figure 10:
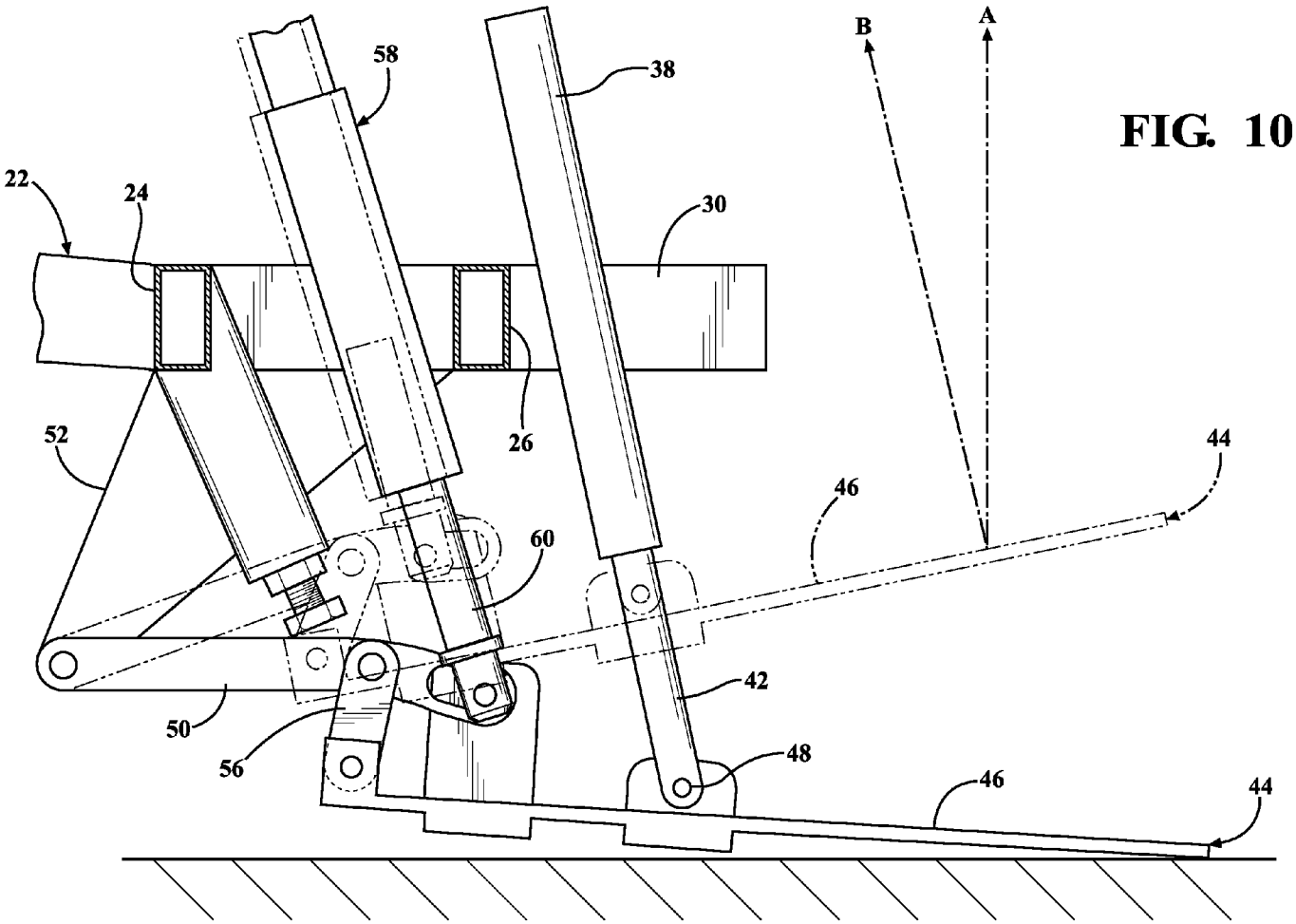
FIG. 10 is an enlarged side view showing the foot platform in a lowered position to receive a user and a phantom view of the foot platform in a raised standing-prone position.

A foot platform, generally indicated at 44, is connected to the mobile base 22 at an elevated, forwardly tilted angle above a ground surface to comfortably support a person in a standing-prone orientation as perhaps best shown in FIGS. 1, 8 and 10. The foot platform 44 may be formed as a single wide tray to receive both feet of a user, or separated plates to receive each foot individually. A standing-prone orientation is defined herein generally as an angle between about 0 and 40 degrees toward the forward facing direction from vertical. This is depicted in FIG. 8 where vertical line A represents the erect standing posture and reference line B represents an axis through a human user in a standing-prone condition. The included angle between A and B is, preferably, about 0-40 degrees. The foot platform or plates 44 have a generally flat standing surface 46 designed to receive the feet of a person in use. Preferably, the standing surface 46 is generally perpendicular to the standing-prone reference line B.

As shown in FIG. 10, the foot platform 44 is operatively connected for articulating movement to the mobile base 22 and the carriage 42 between a lowered condition (shown in solid in FIG. 10) and a raised position (shown in phantom lines in FIG. 10). The raised and lowered conditions of the foot platform 44 correspond with the raised and lowered conditions of the carriage 42. In the preferred embodiment, connection between the foot platforms 44 and the carriage 42 is accomplished via a simple pivoting joint 48. However, connection between the foot platform 44 and the mobile base 22 is accomplished through a more complicated mechanism including a foot control linkage perhaps best shown in FIG. 10. As shown in FIG. 10, a bracket 52 extends rigidly and downwardly from each side edge 28, 30 of the mobile base 22 to provide a pivoting connection for respective left and right link arms 50 which attach on opposite sides of the foot platform 44 via a sliding interface. A secondary link 56 joins the rearward edge of the foot platform 44 to the link arm 50. Those of skill in the mechanical arts will appreciate alternative methods by which re-orientation of the foot platform 44 from an elevated, standing-prone angle to a lowered, rearwardly canted angle (and vise versa) can be accomplished.

The design of the linkage shown in FIG. 10 controls motion of the foot platform 44 between its lowered and raised conditions in such a manner so that when in the lowered condition the foot platforms 44 are tilted toward a rearward-supine direction to facilitate, in use, a user presented in a wheelchair or otherwise in a seated condition. In other words, in the lowered condition the foot platforms 44 are pitched downwardly and rearwardly in a ramp-like fashion so that a user can easily move their feet onto the foot platform 44 without substantial additional effort. When the foot platforms 44 are in the raised condition, the standing surface 46 is disposed at an elevated (i.e., above the ground) condition and tilted toward a forward-prone direction to facilitate, in use, a user standing in the standing-prone orientation as depicted in FIG. 8. In other words, so that the user may have comfortable foot position with respect to the long axis of their body, the standing surface 46 of the foot platforms 44 are oriented generally perpendicular to the standing-prone angle B, as shown in FIG. 10.

Movement of the foot platform 44 between its lowered and raised conditions is accomplished by an actuator, generally indicated at 58 in FIGS. 1-8 and 10. The actuator 58 may take any of various forms including, but not limited to, a linear actuator which may be of the hydraulic or screw jack type including an extendable element 60. In the preferred embodiment depicted perhaps best in FIG. 10, the extendable element 60 of the linear actuator 58 is operatively connected to the foot platform 44 at or about the connection point for the link arm 50. As a result, extension and retraction of the extendable element 60 causes the foot platform 44 to raise and lower between the user-receiving and standing-prone conditions described previously. Because the carriage 42 is attached to the foot platform 44 via the pivot joint 48, the carriage 42 is also moved up and down with actuation of the extendable element 60. Thus, it will be observed that the linear actuator 58 is also operatively connected to the carriage 42 and effective to move the carriage 42 between its raised and lowered conditions. The actuator 58 may be assisted with one or more assist springs, such as the gas over oil pressurized shocks 54 perhaps best shown in FIGS. 3 and 4. The pressurized shocks 54 act as a counterbalance assisting the linear actuator 58 during the lifting and lowering process. In configurations without the pressurized shocks 54, it may be observed that the linear actuator 54 has more capacity when lowering the user (when it needs the least capacity) than in does when raising the user (when it needs the most capacity). Adding pressurized shocks 54, at least in the illustrated embodiment, increases the load on the linear actuator 58 when lowering the user as well as reducing the load on the linear actuator 58 when raising the user, thus balancing out the load requirements of the linear actuator 58 when either raising or lowering the user.

As perhaps best shown in FIG. 5, the actuator 58 may include a motor coupled to a jack screw (i.e., extendable element 60) through a transmission which is pivotally attached to the mobile base 22 via bracket 62. The pivoting connection here enables movement of the foot platform 44 in the complex general plane motion as shown in FIG. 10. The control linkage preferably includes a stabilizer 63. In the illustrated embodiment, the stabilizer 63 is adjustable and takes the form of a threaded bolt extending from the mobile base 22 and poised to engage a forward edge of the foot platform 44 in its raised condition. The stabilizer 63 could, of course, take many different forms to accomplish an equivalent result of counter-acting the moment created in the foot platform 44 due to the weight of the user when in a standing-prone orientation. In one embodiment, the stabilizer 63 has the added benefit of establishing an upward limit of travel and a specific angular posture of the foot platform 44, and may or may not be adjustable in order to fine-tune the angle of the foot platform 44 in its raised condition. The stabilizer 63 is best shown in FIGS. 5-8 and 10. Naturally, other methods and implementations of actuating devices may be used to accomplish similar end results.

Figure 6:
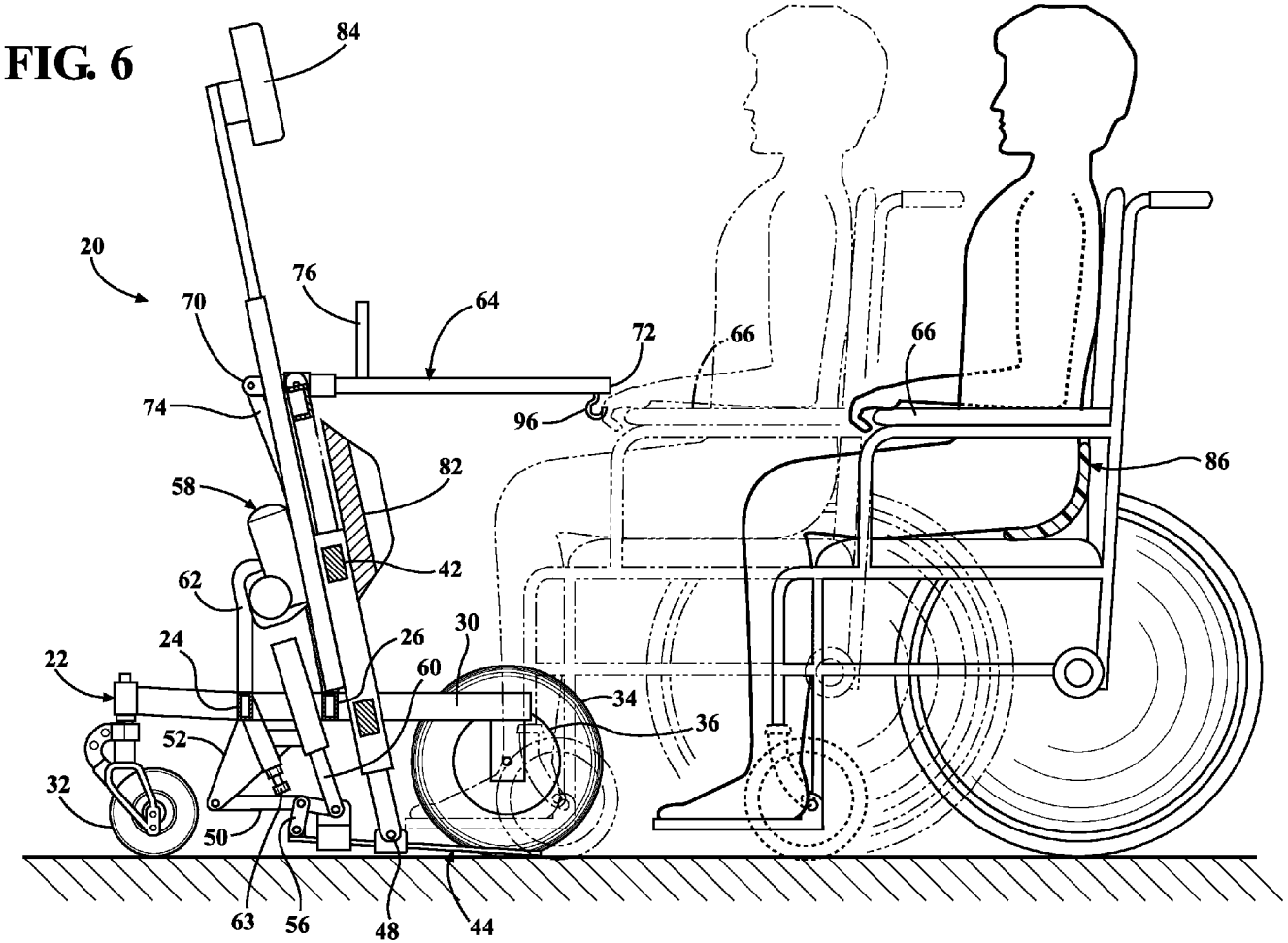
FIG. 6 is a simplified side view showing the device in cross-section with arm and foot platform lowered to receive a person in a wheelchair.
Figure 7:
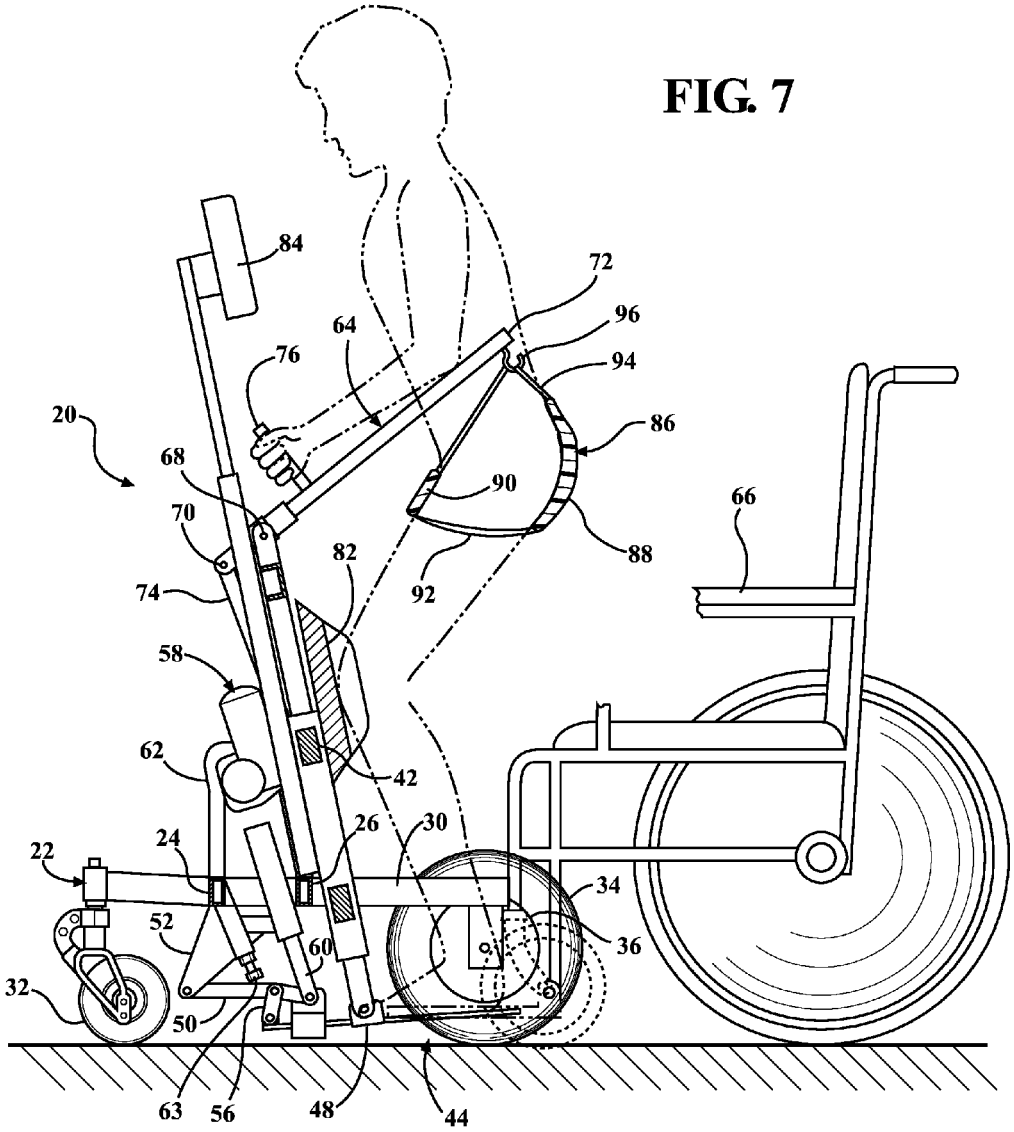
FIG. 7 is a view as in FIG. 6 showing the person in process of transfer from the wheelchair to the device.

Turning again to FIGS. 1-9, the subject device 20 is shown including left and right lift arms, generally indicated at 64. The lift arms 64 are configured to move between raised and lowered conditions in concert with movement of the carriage 42 and/or foot platforms 44 between their respective raised and lowered conditions. In the lowered condition, the left and right lift arms 64 are oriented generally horizontally in a rearward-pointing direction as shown in FIGS. 2-4, 6 and 7. In one implementation of this invention, the lift arms 64 are sized and shaped and so configured that they generally align with the armrests 66 in a standard height wheelchair as shown in FIGS. 6 and 7. This general alignment enables a person transitioning from wheelchair to device 20 or vice versa to have a substantially continuous horizontal arm support provided between the wheelchair armrest 66 and the lift arms 64 of the device 20. Preferably, the lift arms 64 are padded along their length for comfort. This arrangement is conducive for the user to self-transfer to the extent their physical condition allows.

Figure 9:
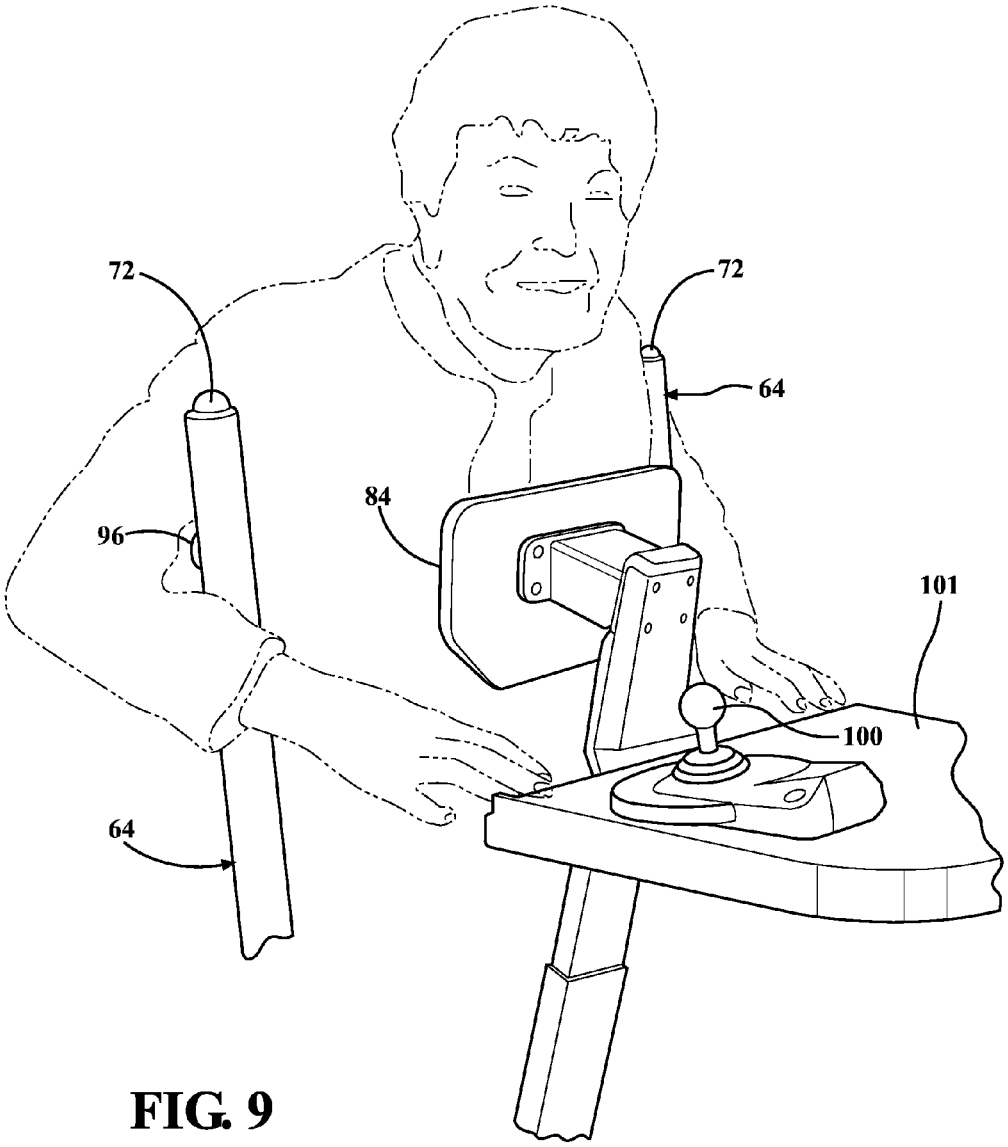
FIG. 9 is a view of the lift arms of the present invention disposed in the raised position with a user standing-prone and the lift arms providing supplemental position control.

Conversely, in the raised condition, the left and right lift arms 64 are oriented generally vertically and lie in a region generally perpendicular to the standing surface 46 of the foot platforms 44. This relationship between the raised position of the lift arms 64 and the standing surface 46 of the foot platforms 44 is perhaps best shown in FIGS. 1 and 8. An objective in this embodiment of the invention is to position the raised lift arms 64 generally perpendicularly above a plane established by the standing surface 46 of the foot platforms 44 (at least when viewed as from the perspective of a side elevation) so that when a person is in a standing-prone position in the device 20 (FIG. 8), the raised lift arms 64 may be positioned directly at the sides of the person. That is to say, in the raised condition the left and right lift arms 64 enable user posture control by assuming respective positions along the left and right sides of a supported user so that the user is able to wrap at least one but preferably both of their arms around the left and right lift arms 64 as shown in FIG. 9.

Those of skill in the art will envision many alternative techniques for supporting the left and right lift arms 64 for the articulating movement described previously. In the depicted embodiment of this invention, the lift arms 64 are each pivotally connected to the upper portion of the carriage 42 at pivot joints 68. Each pivot joint 68 is located very near to a proximal end 70 of each lift arm 64. An opposite, distal end 72 of each lift arm 64 is cantilevered out from the pivot joint 68. The short section or length between the pivot joint 68 and proximal end 70 of each lift arm 64 comprises a crank to which is attached a control linkage 74. The bottom end of the control linkage 74 is pivotally attached to the mobile base 22, and more specifically to a suitable bracket on the left 28 or right 30 edge as the case may be. The upper end of the control linkage 74 is pivotally connected to the proximal end 70 of each lift arm 64. As a result of this arrangement, when the carriage 42 is raised via the actuator 58 in the manner described previously, the pivot joint 68 is pushed upwardly which causes the lift arms 64 to rotate as a result of the control linkage 74 restraining (in tension) the proximal end 70 of each lift arm 64. During lowering, a similar motion occurs in reverse to accomplish the above-described movement of the lift arms 64 between raised and lowered conditions. It will thus be seen that the lift arms 64 move between raised and lowered conditions in concert with the carriage 42 which also moves in concert with the foot platforms 44. The actuator 58 thus simultaneously controls all of these components to effect hoisting of a user between sitting and standing-prone conditions, and vice versa.

Preferably, but by no means necessarily, the left and right lift arms 64 include respective left and right hand grips 76, which may also be padded for comfort. The hand grips 76 are short and extend generally perpendicularly from the respective lift arm 64 adjacent the pivot joint 68. As a result, the lift arms 64 resemble a tonfa and are configured similarly so that when a user grasps the hand grip 76 their forearm overlies the cantilevered portion of the lift arms 64 as shown in FIG. 7. As perhaps best shown in FIGS. 2-4, one of the hand grips 76 may include an electronic toggle switch 78 electrically connected to the actuator 58 so that when pushed in one direction the actuator. 58 will cause the lift arms 64 and foot platforms 44 to move to the raised condition and when manipulated in another direction, the toggle switch 78 causes the actuator 58 to lower the lift arms 64 and foot platforms 44. By conveniently locating the toggle switch 78 on one of the hand grips 76, a user can most ergonomically control their own transfer when physical conditions permit. Another electrical switch 80 may be located on the same or other hand grip 76 to switch between transfer functionality and self-propelled mobility via the motorized rear drive wheels 34 and rear drive unit 36.

Figure 2:
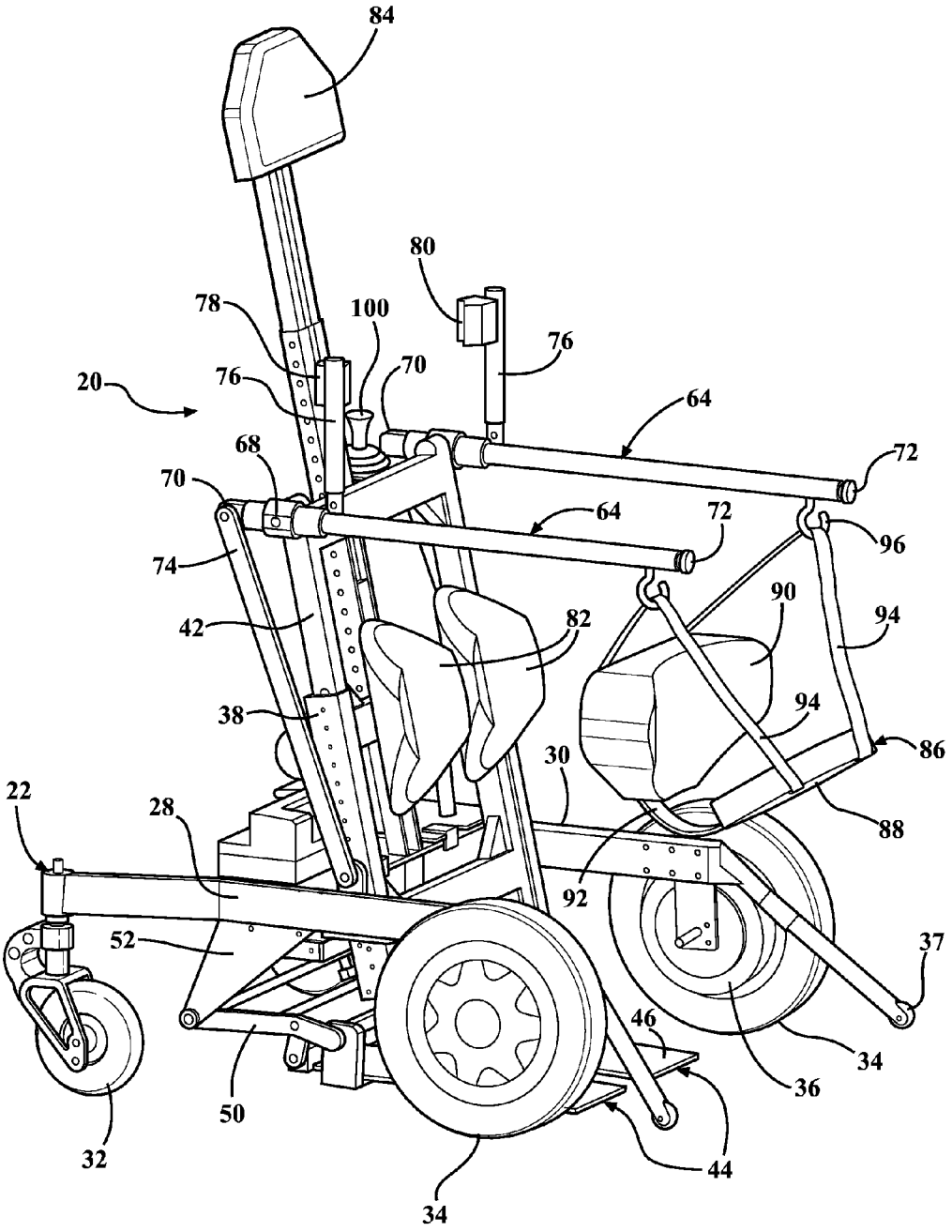
FIG. 2 is a perspective view of a device as in FIG. 1 showing the lift arms and foot platforms in a lowered condition.

Turning now to FIGS. 1, 2 and 6-8, the device 20 is shown including left and right knee pads 82 attached preferably to the carriage 42, although alternatively attached to the mobile base 22 via the towers 38. When the knee pads 82 are attached to the carriage 42, they will move up and down in response to the actuator 58, which condition is preferable. Preferably, the knee pads 82 are located so that when a user seated in a wheelchair or other device is first presented to the device 20, as shown in FIGS. 6 and 7, the knee pads 82 will be located to receive their knees for comfort and position control. As the individual is lifted to a standing-prone position like that shown in FIG. 8, the knee pads 82 continue to provide a supporting function. As shown in FIGS. 1, 2 and 9, a chest pad 84 may also be provided to support the chest of the user or individual. The chest pad 84 may be supported on an extendible bracket to allow comfort adjustment to suit a user. The knee pads 82 and chest pad 84 are both arranged to support the individual in the standing-prone position as shown in FIG. 8, providing support to the front side of the individual. Thus, the knee pads 82 and chest pad 84 provide two points of contact for positioning and supporting the individual. A third point of contact is, of course, provided by the articulating foot platforms 44.

A fourth point of contact for supporting and positioning the individual comprises a seat, generally indicated at 86. The seat 86 may take many forms, and in FIGS. 1-11 is shown as a suspension-type, whereas in FIGS. 13-15 as a rigid, non-suspension-type. Other seat types may also be possible without departing from the spirit of the novel attributes of this present invention. In FIGS. 1-3, the seat 86 is illustrated as a harness-type suspension saddle having a back pad 88, front pad 90 and interconnecting crotch strap 92. Tethers 94 attach the tops of the pads 88, 90 to the distal ends 72 of the lift arms 64 via hooks 96. Referring to FIG. 6, when a user is presented to the device 20, the seat 86 must be installed or previously positioned on the user, after which the user or a caregiver attaches the tethers 94 to the hooks 96 on the ends of the lift arms 64. This is shown for example in FIG. 7. When the toggle switch 78 is manipulated so as to cause the actuator 58 to raise the lift arms 64, the hooks 96 will pull the seat 86 via tethers 94, so that the user is lifted from the pelvic region to the standing-prone position shown in FIG. 8. In other words, the seat 86 preferably, at least in this example, provides a sling-like harness to help support the individual in the standing-prone position. Of course, other seat or harness configurations may be devised depending upon the physical condition of the individual. For example, in some situations it may be necessary to convert the seat 86 to a suspended Torso Lumbar Sacral Orthosis (TLSO) or other type of supporting structure including the alternative embodiment described below in connection with FIGS. 13-15.

Accordingly, in the preferred embodiment the device 20 provides four points of support or contact for the individual during lift and when in the standing-prone condition. These four points of support include the knee pads 82, chest pads 84, seat 86 and foot platforms 44. Additional supporting structures and positioning devices may be used depending upon the particular condition of the user. As one example, FIG. 1 shows a pelvic strap 98 which may be used to cinch or better hold the individual in the standing-prone condition. Additionally, the vertical orientation of the lift arms 64 as previously described provide helpful support and positioning control to the individual in the standing-prone condition. This is illustrated in FIGS. 8 and 9 where the user is able to position the distal ends 72 of the left and right lift arms 64 in front of their shoulders and wrap their arms around the outside of the lift arms 64 in a fashion that helps the individual by providing a sensation of a nearby vertical support that they can grip as tightly or as loosely as needed.

Preferably, some degree of side-to-side movement of a user is enabled within the device 20, presuming that the user is medically able to sustain such movement. This enables the device 20 to replicate to a degree the well-known effects of hippotherapy used in some treatment strategies to achieve functional outcomes. Hippotherapy engages the client in activities on a horse. As is well documented, the dynamic motion of a horse, i.e., up and down and backward and forward and left and right, absorbed by the pelvis of a seated user provides an intensive training of the torso muscles which in turn lead to improved posture and other neurologic and sensory processing functions. Use of the subject device 20, particularly in self-propelled motion over rough or uneven terrain, is believed to simulate to some degree the hippotherapy experience and provide balance and posture improvements as well as many other beneficial therapeutic outcomes for the user. These therapeutic outcomes are in addition to the basic benefits of mobility and independence provided to an individual using the subject device 20.

As perhaps best shown in FIGS. 2 and 9, a remote control joystick 100 may be positioned in a convenient location for a user to control the motion of the drive motors 36 via rear wheels 34 so as to pilot the device 20 as an autonomous mobile unit. In other words, the joystick 100 is electrically connected to the motor drive units 36 in the rear wheels 34, and powered by an on-board battery. Preferably, the joystick 100 is disposed adjacent the proximal end 70 of at least one of the left and right lift arms 64.

According to this configuration, a user may be able prop their upper torso up and wrap at least one arm (but preferably both arms) around a padded lift arm 64. The user then pulls the arm(s) that had been propping up the torso and wraps it around the other lift arm 64 to enable the user to comfortably stretch their entire back, all the while balancing their head atop a properly positioned, stabilized torso which is supported by a pelvis that is stabilized in the suspension saddle 86 with properly aligned lower extremities that are comfortably held in extension with knee pads 82 and feet planted squarely on the foot platforms 44 under level shoulders. All of this is comfortably done (i.e., the progression of movements) at the will of the user, as often as they like and without assistance, presuming the user is physically able. This invention enables improved midline positioning to occur in upper thoracic and cervical region of the user's spine, including shoulders that are symmetrical and a head held high.

In addition to the position control provided by the lift arms 64, the user may be aided further by placing one hand on a front-mounted tray 101 (FIG. 9) for support and trunk stability. A tray may be fabricated with the joystick 100 mounted to one side causing the user to use their non-dominate hand to manipulate the joy stick controller 100 while moving about in self-propelled mode.

Figure 11:
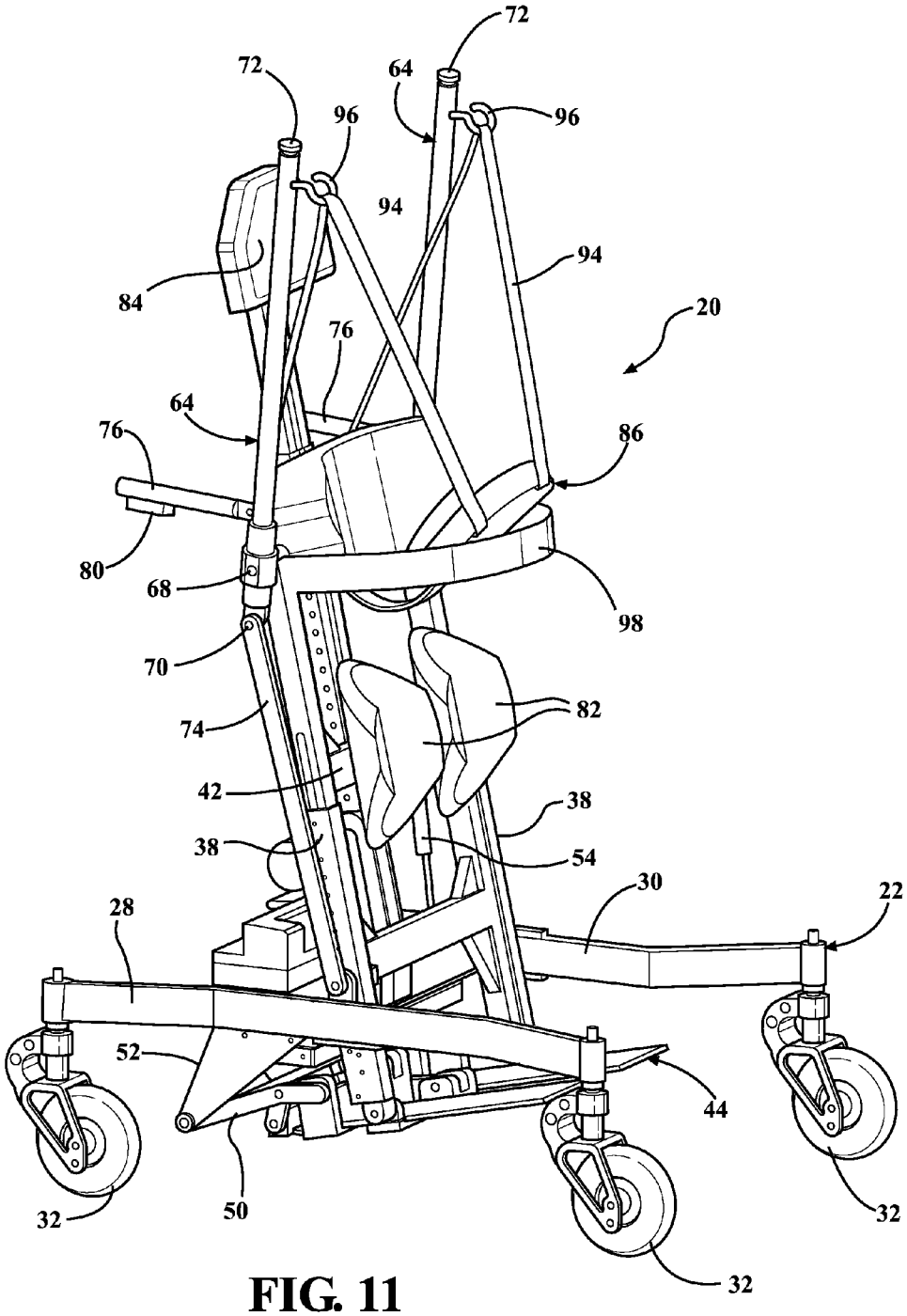
FIG. 11 is a perspective view of an alternative embodiment of the present invention including the user lift functionality as shown in previous views but without power driven transport functionality.

FIG. 11 illustrates an alternative embodiment of the subject device 20 which includes all of the functionality described previously except omits the drive motors 36 in the rear wheels 34. As a result, front 32 and/or rear wheels 34 are affixed to the mobile base 22 via 360 degree swiveling caster-type supports thus requiring manual caregiver support to move a user about their environment when in the standing-prone position. In this configuration, the device 20 may be used for user transfer operations without self-propelled mobility. This embodiment illustrates also that the inventive aspects of user transfer in the standing-prone orientation, and even more specifically of the lift arms 64, may be practiced with non-articulating (i.e., fixed in place) foot platforms.

Figure 12:
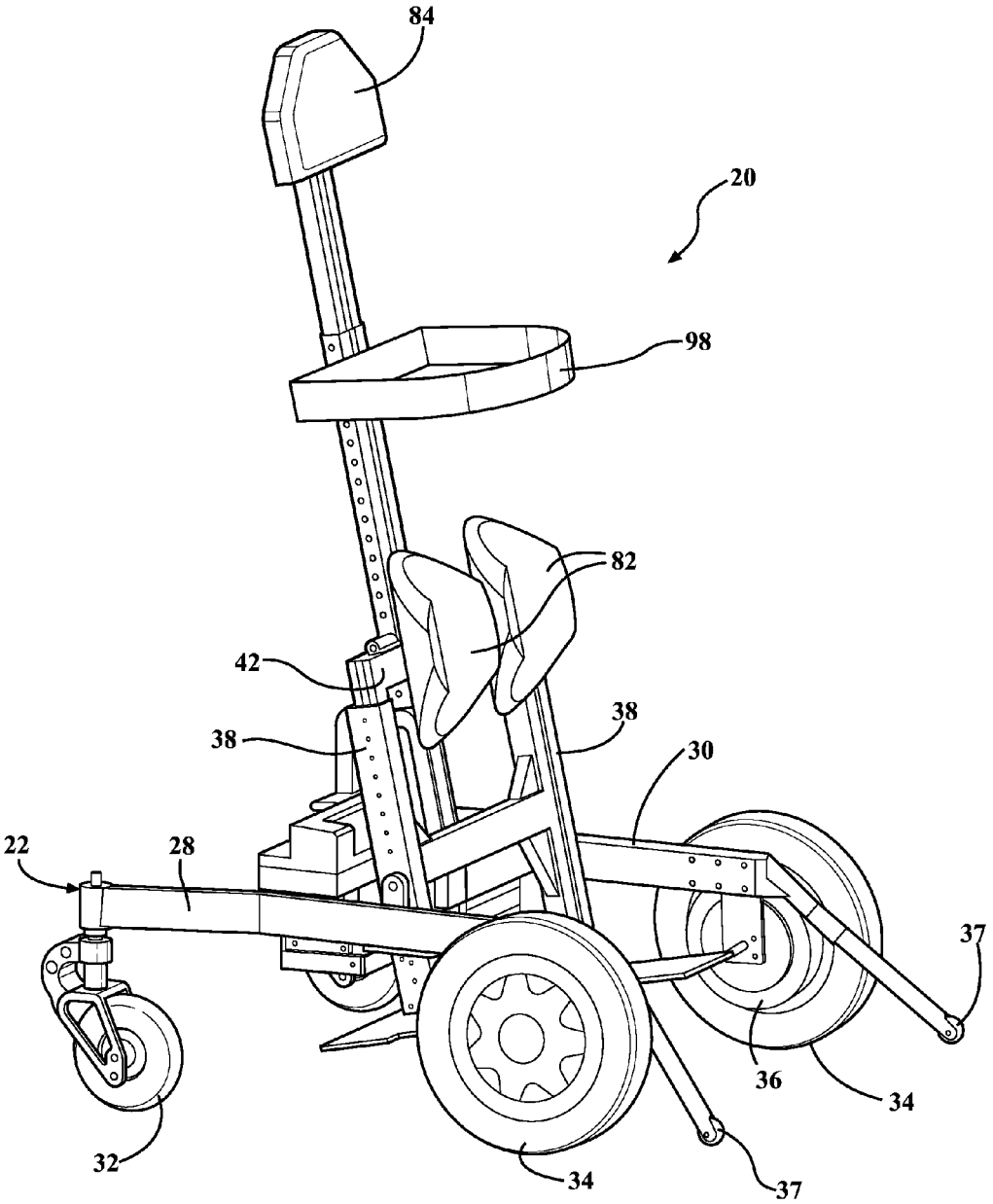
FIG. 12 is a view of a second alternative embodiment of this invention in which the transfer functionality is eliminated but the mobility functionality is retained together with the articulating foot platform concept shown previously.

FIG. 12 shows a second alternative embodiment of the subject invention excluding the transfer functionality afforded by the lift arms. In this embodiment of FIG. 12, the foot platforms 44 are actuated between raised and lowered positions like that described above in connection with FIG. 10, however the lift arms are omitted. The motor drive units 36 are located in the rear wheels 34 so that a user that does not require transfer assistance can be held in a standing-prone position and achieve full mobility with all of the benefits of articulating foot platforms 44 described previously.

Figure 15:
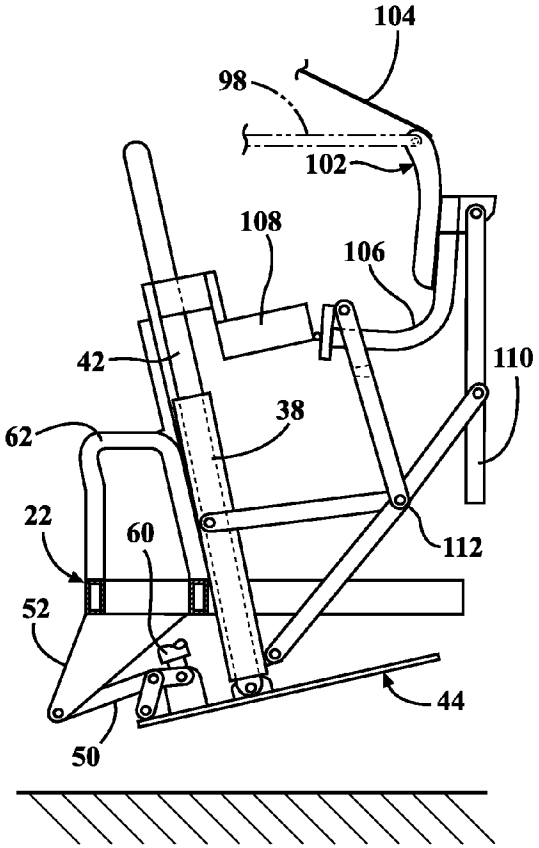
FIGS. 13-15 depict an alternative embodiment for a seating system shown in a progression of movement from seated to standing-pone.
Figure 14:
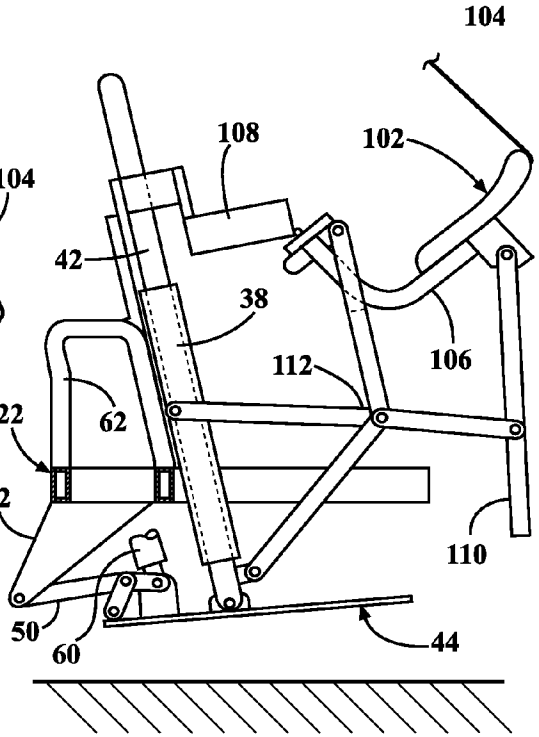
Figure 13:
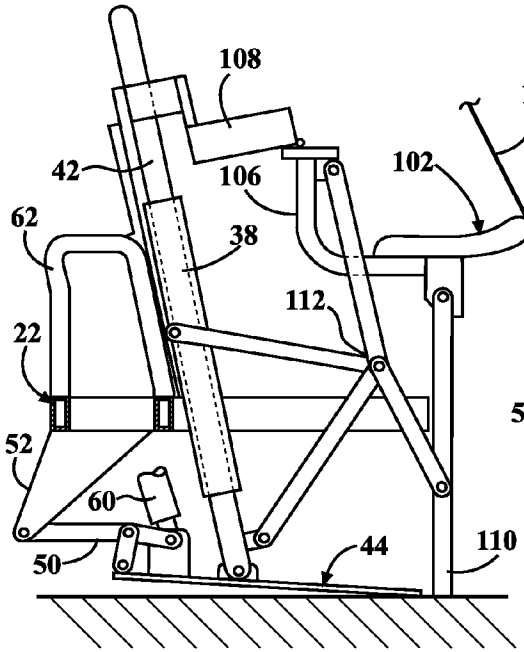

FIGS. 13-15 illustrate an alternative embodiment of the seat 102. In this example, the seat 102 comprises a relatively rigid, padded device similar in some respects to an elongated bicycle seat. Tethers 104 are used to attach to hooks 96 on the lift arms (not shown) as in previous embodiments. The seat 102 is supported on a pivoting L-shaped bar 106 which is hingedly connected to an extension bracket 108 rigidly affixed to the mobile base 22, such as via towers 38. A down post 110 is pivotally connected to the L-shaped bar 106 directly below the seat 102. As the actuator 58 raises the foot platforms 44 in the manner described above, the tethers 104 pull upwardly on the seat 102 thus rotating the L-shaped bar 106 and simultaneously lifting the down post 110. A multilink connector 112 attaches between the down post 110, L-shaped bar 106 (adjacent its hinged connection to the extension bracket 108) as well as to the carriage 42 and also to the mobile base 22. The multilink connector 112 helps to control movement of the down post 110 to a tucked position like that shown in FIG. 15 when the device 20 is in the raised condition.

As shown in FIG. 13, in the raised position the seat 102 assumes a position pressing gently against the lower back and buttocks region of a user to securely hold them in position, while the user's knees (not shown) are pressed against the knee pads 82. A pelvic strap 98 (FIG. 15) may be affixed between seat 102 and the carriage 42 (or fixed upright portion of the mobile base 22) to enhance lateral stability of the user's pelvis when in a standing-prone orientation. This arrangement then provides a secure locked and supported arrangement for an individual without the potential discomfort or installation issues associated with a suspension-type seat like that described in the previous embodiment. Additionally, an advantage of the modified seat 102 as shown in FIGS. 13-15 may be perceived in the transfer of user from a wheelchair, in that they may be able to directly slide onto the seat 102 from the wheelchair seat.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A front loading standing mobility and/or transfer device for handicapped individuals, said device comprising:

a mobile base, a carriage supported with respect to said mobile base for powered movement by an actuator between raised and lowered conditions, a foot platform connected to said mobile base at an elevated forwardly tilted angle above a ground surface to comfortably support a person in a standing-prone orientation, said foot platform having rearward and forward ends, said foot platform operatively coupled to said carriage, said actuator operatively disposed between said foot platform and said mobile base and said carriage, said actuator configured to re-orient said foot platform rearwardly to receive a seated user for front loading when said carriage is in said lowered condition and then return said foot platform to said elevated forwardly tilted condition when said carriage is in said raised condition for user transport and/or mobility at a standing prone angle, a foot control linkage operatively connected to said foot platform, said foot control linkage operative to concurrently lower and tilt said foot platform rearward to the seated user receiving condition with said rearward end of said foot platform lower than said forward end of said foot platform, at least one knee pad attached to said carriage, said at least one knee pad configured to move up and down with said carriage in response to said actuator.

2. The device of claim 1, wherein said foot control linkage includes a stabilizer.

3. The device of claim 1, further including left and right lift arms operatively disposed for articulating movement with respect to said mobile base between a raised condition and a lowered condition.

4. The device of claim 3, further including at least one arm control linkage operatively connected to said respective left and right lift arms, said arm control linkage configured to orient said left and right lift arms generally horizontal in said lowered condition and generally vertical in said raised condition.

5. The device of claim 4, wherein each of said left and right lift arms extend between respective proximal and distal ends, each of said left and right lift arms including a respective crank adjacent said proximal ends thereof, said arm control linkage connected to said cranks of said left and right lift arms.

6. The device of claim 5, wherein said arm control linkage includes at least one drag link pivotally connected between at least one of cranks and said mobile base.

7. The device of claim 4, wherein each of said left and right lift arms include a respective left and right hand grip.

8. The device of claim 7, further including a lift control switch disposed on one of said left and right hand grips.

9. The device of claim 1, wherein said actuator comprises a linear actuator supported on said mobile base, said linear actuator including an extendable element operatively connected to said foot platforms.

10. The device of claim 9, wherein said linear actuator is pivotally connected to said mobile base.

11. The device of claim 1, wherein said carriage is slideably disposed relative to said mobile base along a sliding path tilted forwardly along a standing-prone angle.

12. The device of claim 1, further including left and right lift arms operatively disposed for articulating movement with respect to said mobile base between a raised condition and a lowered condition, said lift arms pivotally connected to said carriage, and at least one arm control linkage operatively connected to said respective left and right lift arms, said arm control linkage configured to orient said left and right lift arms generally horizontal in said lowered condition and generally vertical in said raised condition.

13. The device of claim 1, further including at least two wheels attached to said mobile base, at least one of said wheels including an electric motor drive unit operatively associated therewith.

14. The device of claim 13, wherein at least one of said wheels includes a caster support.

15. The device of claim 1, further including left and right lift arms operatively disposed for articulating movement with respect to said mobile base between a raised condition and a lowered condition, wherein each of said left and right lift arms extend between respective proximal and distal ends, further comprising a seat operatively connected to said distal ends of said respective left and right lift arms.

16. The device of claim 15, wherein said left and right lift arms each include a hook, said seat including left and right flexible tethers selectively attachable to said hooks.

17. A front loading standing mobility and/or transfer device for handicapped individuals, said device comprising:

a mobile base, a foot platform connected to said mobile base, said foot platform having a generally flat standing surface, said foot platform having rearward and forward ends, left and right lift arms operatively connected with respect to said mobile base for articulating movement between a lowered condition and a raised condition, each of said left and right lift arms extending between a proximal end and a cantilevered distal end, an actuator supported relative to said mobile base, said actuator effective to selectively move said left and right lift arms between raised and lowered conditions, at least one arm control linkage operatively connected to said respective left and right lift arms, said arm control linkage configured to orient said left and right lift arms generally horizontal in said lowered condition and generally vertical in said raised condition, a foot control linkage operatively connected to said foot platform, said foot control linkage operative to manipulate said foot platform between a forwardly tilted standing-prone orientation when said left and right lift arms are in said raised position and a rearwardly tilted receiving orientation for front loading a user when said left and right lift arms are in said lowered condition, said foot control linkage including a stabilizer configured to engage said foot platform in said raised condition for establishing at least one of an upward limit of travel and a specific angular posture of said foot platform when in said raised condition, a carriage supported with respect to said mobile base for powered movement by said actuator between raised and lowered conditions, and at least one knee pad attached to said carriage, said at least one knee pad configured to move up and down with said carriage in response to said actuator.

18. The device of claim 17, wherein said actuator is further operatively disposed between said foot platform and said mobile base to elevate said foot platform in said forwardly tilted standing-prone orientation and to lower said foot platform in said rearwardly tilted receiving orientation, and wherein said stabilizer is adjustable.

19. A front loading standing mobility and/or transfer device comprising:

a mobile base, a least two wheels attached to said mobile base, at least one of said wheels including an electric motor drive unit operatively associated therewith, a carriage slideably disposed with respect to said mobile base for powered movement between raised and lowered conditions, a foot platform connected to said mobile base at an elevated forwardly tilted angle above a ground surface to comfortably support a person in a standing-prone orientation, said foot platform having a generally flat standing surface, said foot platform operatively connected for articulating movement between said mobile base and said carriage between a lowered condition and a raised condition corresponding with said raised and lowered conditions of said carriage, a foot control linkage operatively disposed between said foot platform and said mobile base, wherein in said lowered condition said foot platforms are tilted toward said rearward-supine direction to facilitate in use a user presented in a seated condition for front loading, and wherein in said raised condition said foot platforms are tilted toward said forward-prone direction to facilitate in use a user the standing-prone orientation, said foot control linkage including an adjustable stabilizer configured to engage said foot platform in said raised condition for establishing at least one of an upward limit of travel and a specific angular posture of said foot platform when in said raised condition, a linear actuator supported on said mobile base, said linear actuator including an extendable element operatively connected to said carriage and effective to move said carriage between raised and lowered conditions in response to movement of extendable element, left and right lift arms operatively connected for articulating movement with respect to said carriage between a lowered condition and a raised condition corresponding with said raised and lowered conditions of said carriage, left and right arm control linkages operatively disposed between said respective left and right lift arms and said mobile base, each of said left and right lift arms extending between a proximal end adjacent said carriage and a cantilevered distal end, each of said left and right lift arms including a respective left and right crank adjacent said proximal ends thereof, a lift control switch disposed on one of said left and right lift arms, said left arm control linkage including a left drag link pivotally connected at one end thereof to said left crank and at another end thereof to said mobile base, said right arm control linkage including a right drag link pivotally connected at one end thereof to said right crank and at another end thereof to said mobile base, said each of said left and right lift arms including a respective left and right hand grip extending generally perpendicularly, wherein in said lowered condition said left and right lift arms are oriented generally horizontally and wherein in said raised condition said left and right lift arms are oriented generally vertically and lie in a region generally above said standing surface of said foot platform, wherein in said raised condition said left and right lift arms enable user posture control by assuming a respective positions along the sides of a supported user so that the user is able to wrap at least one of their arms around one of the left and right lift arms, left and right knee pads attached to said carriage, said at least one knee pad configured to move up and down with said carriage in response to said linear actuator, an adjustable chest pad extending upwardly from said mobile base, seat operatively connected to said distal ends of said respective left and right lift arms, a remote control joy-stick electrically connected to said electric motor drive unit in said wheel.

* * * * *